US007182589B2

(12) United States Patent
Porter

(10) Patent No.: US 7,182,589 B2
(45) Date of Patent: Feb. 27, 2007

(54) EMBEDMENT DEVICE FOR FIBER-ENHANCED SLURRY

(75) Inventor: Michael J. Porter, Hanover Park, IL (US)

(73) Assignee: United States Gypsum Company, Chicago, IL (US)

( * ) Notice: Subject to any disclaimer, the term of this patent is extended or adjusted under 35 U.S.C. 154(b) by 231 days.

(21) Appl. No.: 10/665,541

(22) Filed: Sep. 18, 2003

(65) Prior Publication Data

US 2005/0064055 A1 Mar. 24, 2005

(51) Int. Cl.
*B28B 3/12* (2006.01)

(52) U.S. Cl. ..... 425/115; 425/335; 425/336; 425/373; 425/403

(58) Field of Classification Search ..... 425/115, 425/335, 336, 373, 403
See application file for complete search history.

(56) References Cited

U.S. PATENT DOCUMENTS 2,655,978 A * 10/1953 Gonda et al. ..... 156/201
3,901,634 A 8/1975 Webb et al.
4,420,295 A 12/1983 Clear et al.
4,504,335 A 3/1985 Galer
4,514,090 A 4/1985 Neubauer et al.
5,020,916 A * 6/1991 Fritsch ..... 366/97
5,325,954 A * 7/1994 Crittenden et al. ..... 198/382
5,340,518 A * 8/1994 Paul ..... 264/154
5,685,903 A 11/1997 Stav et al.
5,858,083 A 1/1999 Stav et al.
5,958,131 A 9/1999 Asbridge et al.
6,176,920 B1 1/2001 Murphy et al.

FOREIGN PATENT DOCUMENTS

DE 1266198 4/1968

* cited by examiner

*Primary Examiner*—Yogendra N. Gupta
*Assistant Examiner*—Maria Veronica Ewald
(74) *Attorney, Agent, or Firm*—Greer, Burns & Crain, Ltd.; Michael M. Geoffrey; David F. Janci

(57) ABSTRACT

An embedment device for use in a structural panel production line wherein a slurry is transported on a moving carrier relative to a support frame, and chopped fibers are deposited upon the slurry, includes a first elongate shaft secured to the support frame and having a first plurality of axially spaced disks, a second elongate shaft secured to the support frame and having a second plurality of axially spaced disks, the first shaft being disposed relative to the second shaft so that the disks intermesh with each other. The intermeshing relationship enhances embedment of the fibers into the slurry and also prevents clogging of the device by prematurely set slurry particles.

1 Claim, 2 Drawing Sheets

EMBEDMENT DEVICE FOR FIBER-ENHANCED SLURRY

CROSS REFERENCE TO RELATED APPLICATIONS

This application is related to co-pending applications U.S Ser. No. 10/664,460 entitled SLURRY FEED APPARATUS FOR STRUCTURAL CEMENT PANEL PRODUCTION and U.S. Ser. No. 10/666,294 entitled MULTI-LAYER PROCESS AND APPARATUS FOR OBTAINING INCREASED STRENGTH CEMENT PANELS, filed concurrently herewith and herein incorporated by reference.

FIELD OF THE INVENTION

This invention relates generally to devices for embedding fibers in settable slurries, and specifically to a device designed for embedding fibers in a settable cement slurry along a cement board or cementitious structural panel ("SCP") production line.

Cementitious panels have been used in the construction industry to form the interior and exterior walls of residential and/or commercial structures. The advantages of such panels include resistance to moisture compared to standard gypsum-based wallboard. However, a drawback of such conventional panels is that they do not have sufficient structural strength to the extent that such panels may be comparable to, if not stronger than, structural plywood or oriented strand board (OSB).

Typically, the cementitious panel includes at least one hardened cement or plaster composite layer between layers of a reinforcing or stabilizing material. In some instances, the reinforcing or stabilizing material is fiberglass mesh or the equivalent. The mesh is usually applied from a roll in sheet fashion upon or between layers of settable slurry. Examples of production techniques used in conventional cementitious panels are provided in U.S. Pat. Nos. 4,420,295; 4,504,335 and 6,176,920, the contents of which are incorporated by reference herein. Further, other gypsum-cement compositions are disclosed generally in U.S. Pat. Nos. 5,685,903; 5,858,083 and 5,958,131.

One drawback of conventional processes for producing cementitious panels is that the fibers, applied in a mat or web, are not properly and uniformly distributed in the slurry, and as such, the reinforcing properties resulting due to the fiber-matrix interaction vary through the thickness of the board, depending on the thickness of each board layer. When insufficient penetration of the slurry through the fiber network occurs, poor bonding between the fibers and the matrix results, causing low panel strength. Also, in some cases when distinct layering of slurry and fibers occurs, improper bonding and inefficient distribution of fibers causes poor panel strength development.

Another drawback of conventional processes for producing cementitious panels is that the resulting product is too costly and as such is not competitive with outdoor/structural plywood or oriented strand board (OSB).

One source of the relatively high cost of conventional cementitious panels is due to production line downtime caused by premature setting of the slurry, especially in particles or clumps which impair the appearance of the resulting board, and interfere with the efficiency of production equipment. Significant buildups of prematurely set slurry on production equipment require shutdowns of the production line, thus increasing the ultimate board cost.

In instances, such as disclosed in commonly-assigned Ser. No. 10/666,294, entitled MULTI-LAYER PROCESS AND APPARATUS FOR OBTAINING INCREASED STRENGTH CEMENT PANELS, where loose chopped fiberglass fibers are mixed with slurry to provide a cementitious structural panel having structural reinforcement, the need arises for a way to thoroughly mix the fibers with the slurry. Such uniform mixing is important for achieving the desired structural strength of the resulting panel or board.

A design criteria of any device used to mix settable slurries of this type is that production of the board should continue uninterrupted during manufacturing runs. Any shutdowns of the production line due to the cleaning of equipment should be avoided. This is a particular problem when quick-setting slurries are created, as when fast setting agents or accelerators are introduced into the slurry.

A potential problem when creating cement structural panels in a moving production line, is for portions of the slurry to prematurely set, forming blocks or chunks of various sizes. When these chunks break free and become incorporated into the final board product, they interfere with the uniform appearance of the board, and also cause structural weaknesses. In conventional structural cement panel production lines, the entire production line must be shut down to clean clogged equipment to avoid the incorporation of prematurely set slurry particles into the resulting board.

Another design criteria of devices used to mix chopped reinforcing fibers into a slurry is that the fibers need to be mixed into the relatively thick slurry in a substantially uniform manner to provide the required strength.

Thus, there is a need for a device for thoroughly mixing fiberglass or other structural reinforcing fibers into a settable slurry in a way so that the device does not become clogged or impaired by chunks or setting slurry.

BRIEF DESCRIPTION OF THE INVENTION

The above-listed needs are met or exceeded by the present invention that features an embedment device including at least a pair of elongate shafts disposed on the fiber-enhanced settable slurry board production line to traverse the line. The shafts are preferably disposed in spaced parallel relation to each other. Each shaft has a plurality of axially spaced disks along the shaft. During board production, the shafts and the disks rotate axially. The respective disks of the adjacent, preferably parallel shafts are intermeshed with each other for creating a "kneading" or "massaging" action in the slurry, which embeds previously deposited fibers into the slurry. In addition, the close, intermeshed and rotating relationship of the disks prevents the buildup of slurry on the disks, and in effect creates a "self-cleaning" action which significantly reduces board line downtime due to premature setting of clumps of slurry.

More specifically, the invention provides an embedment device for use in a structural panel production line wherein a slurry is transported on a moving carrier relative to a support frame, and chopped fibers are deposited upon the slurry. Included on the device is a first elongate shaft secured to the support frame and having a first plurality of axially spaced disks, a second elongate shaft secured to the support frame and having a second plurality of axially spaced disks, the first shaft being disposed relative to the second shaft so that the disks intermesh with each other.

In the preferred embodiment, each adjacent pair of the main or relatively larger diameter disks are separated on the respective shaft by a relatively small diameter spacer disk. The intermeshed relationship includes a closely adjacent disposition of opposing peripheries of small diameter spacer disks and relatively large diameter main disks, which also facilitates the self-cleaning action.

DETAILED DESCRIPTION OF THE INVENTION

Figure 1:
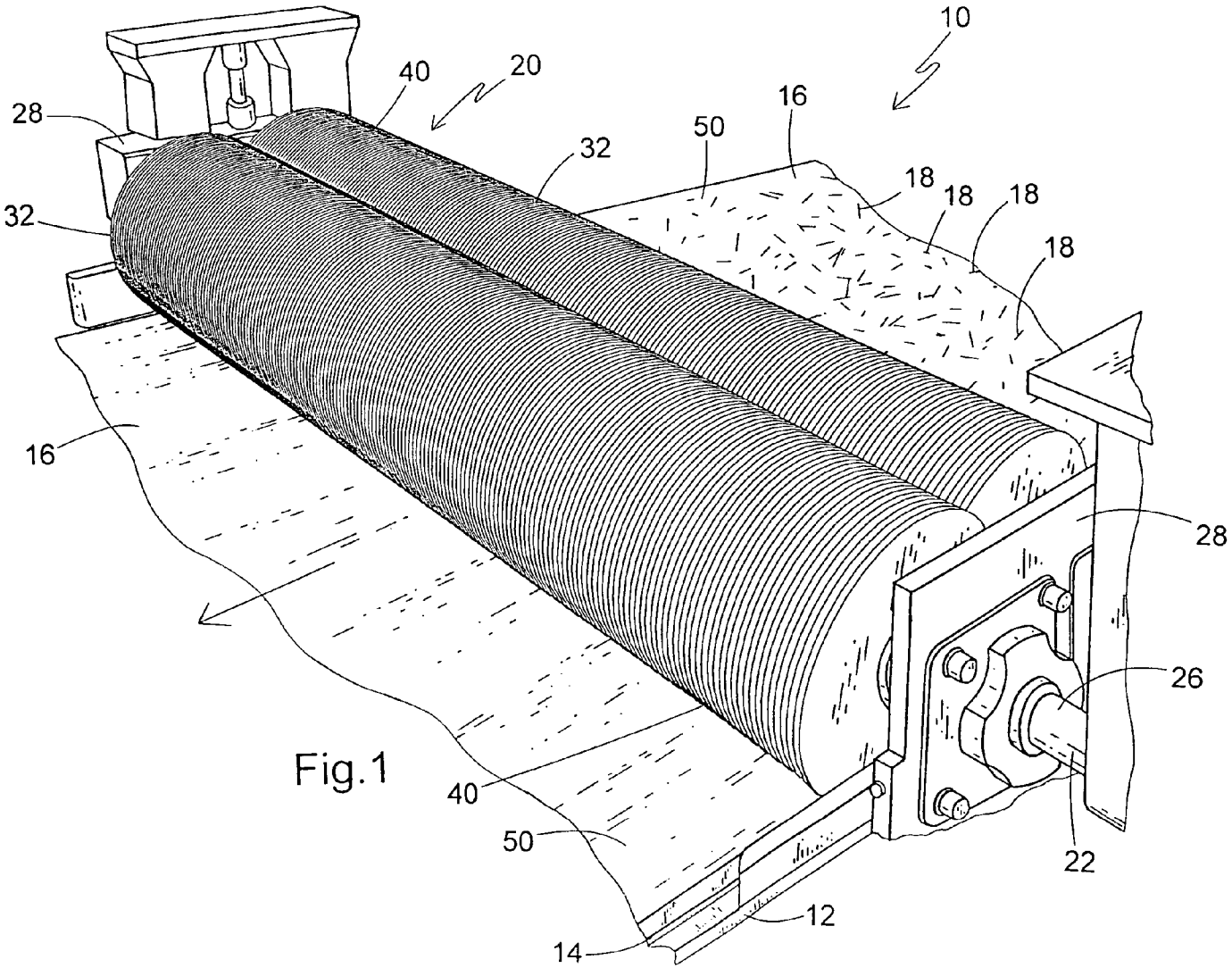
FIG. 1 is a top perspective view of the present embedment device on a structural slurry board production line.
Figure 2:
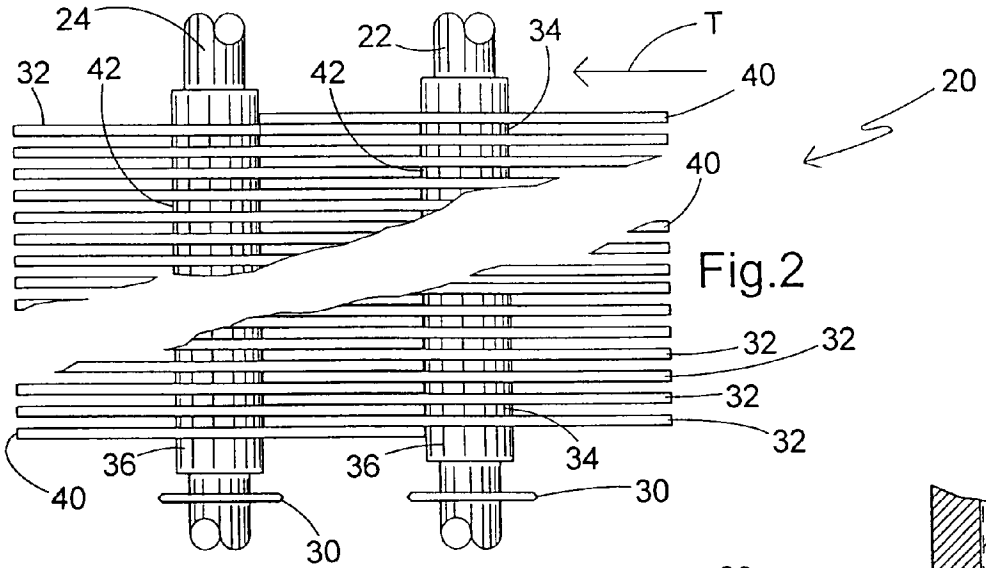
FIG. 2 is a fragmentary overhead plan view of the embedment device of FIG. 1.

Referring now to FIGS. 1 and 2, a structural panel production line is fragmentarily shown and is generally designated 10. The production line 10 includes a support frame or forming table 12 which supports a moving carrier 14, such as a rubber-like conveyor belt, a web of craft paper, release paper, and/or other webs of support material designed for supporting a slurry prior to setting, as is well known in the art. The carrier 14 is moved along the support frame 12 by a combination of motors, pulleys, belts or chains and rollers (none shown) which are also well known in the art. Also, while the present invention is intended for use in producing structural cement panels, it is contemplated that it may find application in any situation in which bulk fibers are to be mixed into a settable slurry for board or panel production.

While other sequences are contemplated depending on the application, in the present invention, a layer of slurry 16 is deposited upon the moving carrier web 14 to form a uniform slurry web. While a variety of settable slurries are contemplated, the present embedment device is particularly designed for use in producing structural cement panels. As such, the slurry is preferably made up of varying amounts of Portland cement, gypsum, aggregate, water, accelerators, plasticizers, foaming agents, fillers and/or other ingredients well known in the art. The relative amounts of these ingredients, including the elimination of some of the above or the addition of others, may vary to suit the application. A supply of chopped fibers 18, which in the preferred embodiment are chopped fiberglass fibers, are dropped or sprinkled upon the moving slurry web 16.

The present embedment device, generally designated 20, is disposed on the support frame 12 to be just "downstream" or after the point at which the fibers 18 are deposited upon the slurry web 16. Included in the device 20 are at least two elongate shafts 22, 24 each having ends 26 engaged in a bracket 28 located on each side of the support frame 12. Although two shafts 22, 24 are depicted, additional shafts may be provided if desired. One set of shaft ends 26 is preferably provided with toothed sprockets or pulleys 30 (best seen in FIG. 2) or other driving mechanism to enable the shafts 22, 24 to be axially rotated in the brackets 28. Motorized belt drives, chain drives or other typical systems for driving rollers or shafts along a production line are considered suitable here. It will be seen that the shafts 22, 24 are mounted generally transversely on the support frame 12, and are in spaced, generally parallel relationship to each other. In the preferred embodiment, the shafts 22, 24 are parallel to each other.

Figure 3:
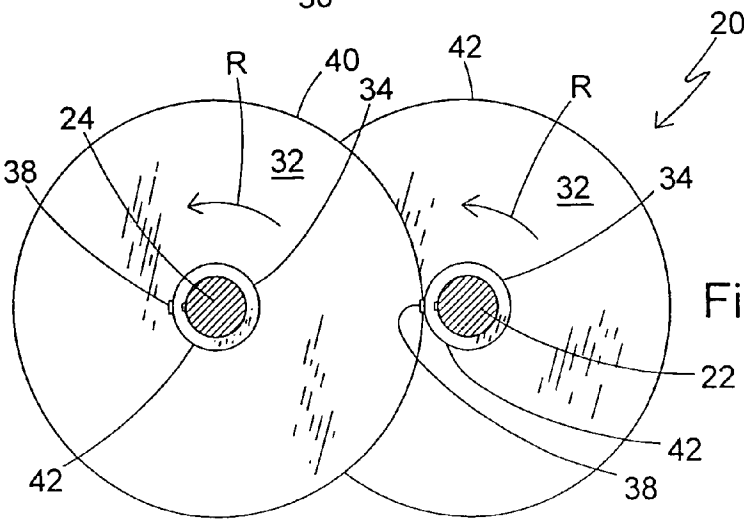
FIG. 3 is a side elevation of the embedment device of FIG. 2.

Each of the shafts 22, 24 is provided with a plurality of axially spaced main or relatively large disks 32, with adjacent disks being axially spaced from each other. The spacing is maintained by a second plurality of relatively smaller diameter spacer disks 34 (FIG. 2) which are each located between an adjacent pair of main disks 32. As is seen in FIG. 3, it is preferred that at least the main disks 32, and preferably both the main and the spacer disks 32, 34 are keyed to the respective shaft 22, 24 for common rotation. The toothed sprockets 30 are also preferably keyed or otherwise secured to the shafts 22, 24 for common rotation. In the preferred embodiment, keyed collars 36 (best seen in FIG. 3) located adjacent each shaft end 26 are secured to the shaft, as by set keys or set screws 38 and retain the disks 32, 34 on the shafts 22, 24 against lateral movement.

It will also be seen from FIGS. 1–3 that the disks 32, 34 of the respective shafts 22, 24 are intermeshed with each other, so that the main disks 32 of the shaft 22 are located between disks 32 of the shaft 24. It will also be seen that, upon becoming intermeshed, peripheral edges 40 of the main disks 32 overlap each other, and are disposed to be in close, yet rotational relationship to peripheral edges 42 of the opposing spacer disks 34 of the opposing shaft (best seen in FIG. 3). It is preferred that the shafts 22, 24, and the associated disks 32, 34, are rotated in the same direction 'R' (FIG. 3).

While the relative dimensions of the disks, 32, 34 may vary to suit the application, in the preferred embodiment, the main disks 32 are ¼" thick and are spaced 5/16" apart. Thus, there is a close, yet relatively rotational tolerance created when the adjacent disks 32 of the shafts, 22, 24 intermesh with each other (best seen in FIG. 2). This close tolerance makes it difficult for particles of the settable slurry 16 to become caught between the disks 32, 34 and set prematurely. Also, since the shafts 22, 24, and the associated disks 32, 34 are constantly moving during SCP panel production, any slurry which is caught between the disks is quickly ejected, and has no chance to set in a way which would impair the embedment operation. It is also preferred that the peripheries of the disks 32, 34 are flattened or perpendicular to the plane of the disk, but it is also contemplated that tapered or otherwise angled peripheral edges 40, 42 could be provided and still achieve satisfactory fiber embedment.

The self-cleaning property of the present embedment device 20 is further enhanced by the materials used for the construction of the shafts 22, 24 and the disks 32, 34. In the preferred embodiment, these components are made of stainless steel which has been polished to obtain a relatively smooth surface. Also, stainless steel is preferred for its durability and corrosion resistance, however other durable, corrosion resistant and non-stick materials are contemplated, including Plexiglas material or other engineered plastic materials.

Further, the height of the shafts 22, 24 relative to the moving web 14 is preferably adjustable to promote embedment of the fibers 18 into the slurry 16. It is preferred that the disks 32 not contact the carrier web 14, but extend sufficiently into the slurry 16 to promote embedment of the fibers 18 into the slurry. The specific height of the shafts 22, 24 above the carrier web 14 may vary to suit the application, and will be influenced, among other things, by the diameter of the main disks 32, the viscosity of the slurry, the thickness of the slurry layer 16 and the desired degree of embedment of the fibers 18.

Figure 4:
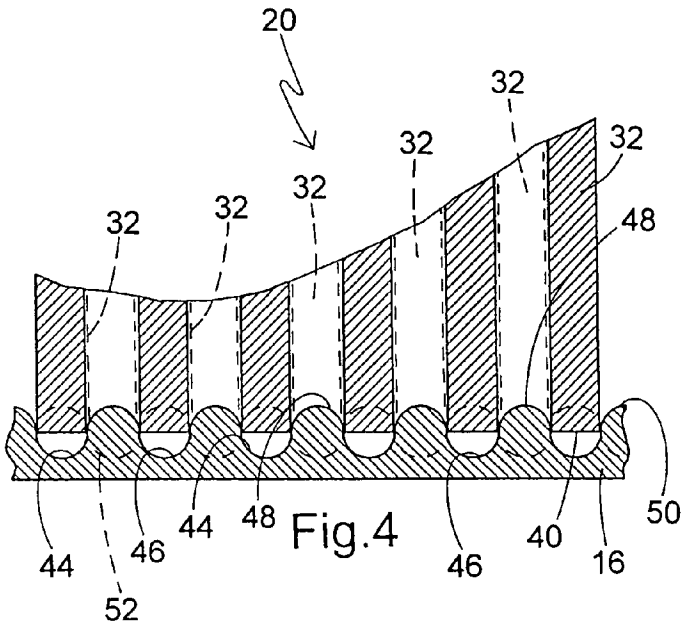
FIG. 4 is a schematic diagram of the patterns of embedment tracks/troughs created in the slurry by the present embedment device.

Referring now to FIG. 4, the plurality of main disks 32 on the first shaft 22 are disposed relative to the frame 12 to create a first trough pattern 44 (solid lines) in the slurry 16 for embedding the fibers 18 therein. The trough pattern 44 includes a series of valleys 46 created by the disks 32 and hills 48 located between the disks as the slurry 16 is pushed to the sides of each disk. Since the fibers 18 have been immediately previously deposited upon an upper surface 50 of the slurry 16, a certain percentage of the fibers will become mixed into the slurry through the formation of the first trough pattern 44. It will be appreciated that as the shafts 22, 24 are rotating and turning the associated disks 32, 34, the carrier web or belt 14 is also moving in a direction of travel 'T' (FIG. 2) from the first shaft 22 to the second shaft 24. In this manner, a churning dynamic movement is also created which will enhance the embedment of the fibers 18.

Immediately after leaving the vicinity of the disks 32 of the first shaft 22, the slurry 16 encounters the disks 32 of the second shaft 24 (shown in phantom), which proceed to create a second trough pattern 52. Due to the laterally offset position of the disks 32 of the respective shafts 22, 24, at any selected point, the second trough pattern 52 is opposite to the pattern 44, in that hills 54 replace the valleys 46, and valleys 56 replace the hills 48. In that the trough patterns 44, 52 generally resemble sinusoidal waves, it may also be stated that the trough patterns 44, 52 are out of phase relative to each other. This transversely offset trough pattern 52 further churns the slurry 16, enhancing the embedment of the fibers 18. In other words, a slurry massaging or kneading action is created by the rotation of the intermeshed disks 32 of the shafts 22, 24.

Thus, the present embedment device provides a mechanism for incorporating or embedding chopped fiberglass fibers into a moving slurry layer. An important feature of the present device is that the disks of the respective shafts are intermeshed with, and overlap each other for providing a kneading, massaging or churning action to the slurry in a way which minimizes the opportunity for slurry to clog or become trapped in the device.

While a particular embodiment of an embedment device for a fiber-enhanced slurry has been shown and described, it will be appreciated by those skilled in the art that changes and modifications may be made thereto without departing from the invention in its broader aspects and as set forth in the following claims.

What is claimed is:

1. An embedment device for use in embedding fibers into a settable slurry used in producing a structural board on a board production line including a support frame, said device comprising:

a first elongate support shaft secured to the frame and having a first plurality of relatively large diameter axially aligned and axially fixed disks stacked axially along said shaft in between a first plurality of relatively small diameter axially aligned and axially fixed disks;

a second elongate support shaft secured to the frame and having a second plurality of relatively large diameter axially aligned and axially fixed disks stacked axially along said shaft in between a second plurality of relatively small diameter axially aligned and axially fixed disks;

said first and second support shafts positioned relative to each other to be horizontally aligned and so that said first plurality of relatively large diameter disks are intermeshed with said second plurality of relatively large diameter disks, said intermeshed relationship creating a close, yet relatively rotational tolerance between adjacent disks of said opposing first and second support shafts for self cleaning;

each of said first plurality of relatively large diameter disks overlapping a corresponding one of said second plurality of relatively large diameter disks approximately the length of a radius of said large diameter disks;

peripheries of said first and second pluralities of relatively large diameter disks being in close proximity to corresponding peripheries of said opposed relatively small diameter disks for preventing said slurry from becoming caught between said relatively large diameter disks and said relatively small diameter disks;

said shafts being oriented on the frame to be generally parallel to each other and to define a plane vertically displaced from and parallel to said board production line;

said first plurality of relatively large diameter disks being disposed relative to the frame to create a first trough pattern in the slurry for embedding the fibers therein, and said second plurality of relatively large diameter disks being disposed relative to the frame to create a second trough pattern in the slurry, said second trough pattern being transversely offset from said first pattern; and said first and second shafts, and said associated disks, rotate in the same direction.

* * * * *